US009114310B1

(12) United States Patent
Poisson

(10) Patent No.: US 9,114,310 B1
(45) Date of Patent: Aug. 25, 2015

(54) METHOD FOR PLAYING A CARD GAME THAT SIMULATES A GAME OF FOOTBALL WITH KIBITZ AND SIDE BET OPTIONS

(76) Inventor: Renald Poisson, Houston, TX (US)

( * ) Notice: Subject to any disclaimer, the term of this patent is extended or adjusted under 35 U.S.C. 154(b) by 1126 days.

(21) Appl. No.: 12/427,040

(22) Filed: Apr. 21, 2009

Related U.S. Application Data

(60) Provisional application No. 61/046,846, filed on Apr. 22, 2008.

(51) Int. Cl.
*A63F 1/00* (2006.01)
*A63F 3/00* (2006.01)
*A63F 7/06* (2006.01)

(52) U.S. Cl.
CPC ..... *A63F 3/00041* (2013.01); *A63F 3/00157* (2013.01); *A63F 7/0616* (2013.01)

(58) Field of Classification Search
CPC A63F 3/00041; A63F 3/00157; A63F 7/0616
USPC ..... 273/247, 298, 274
See application file for complete search history.

(56) References Cited

U.S. PATENT DOCUMENTS

| | | | | | |
|---|---|---|---|---|---|
| 1,701,655 | A | * | 2/1929 | Andrews | 273/247 |
| 4,706,959 | A | * | 11/1987 | Price | 273/247 |
| 5,772,512 | A | * | 6/1998 | Chichester | 463/40 |
| 5,906,370 | A | | 5/1999 | Poisson | |
| 2006/0252530 | A1 | | 11/2006 | Oberberger et al. | |

* cited by examiner

*Primary Examiner* — Benjamin Layno
(74) *Attorney, Agent, or Firm* — Buskop Law Group, P.C.; Wendy Buskop

(57) ABSTRACT

A method for playing a card game that simulates a game of football with kibitz and side bet options, comprising providing a play area, providing a deck of playing cards and a deck of special teams cards, and randomizing the decks of cards. At least one spectator can be permitted to place at least one bet. First and second pluralities of cards are then dealt to a first player and a second player, respectively. A football offense player and a football defense player are designated, and the football offense player is permitted to select and play a first card. Depending on the type of card played, the football defense player can be permitted to play a second card for discard or in response to the first card. A game outcome is determined based on the cards played, and winnings are awarded based on the bets placed and the game outcome.

20 Claims, 2 Drawing Sheets

METHOD FOR PLAYING A CARD GAME THAT SIMULATES A GAME OF FOOTBALL WITH KIBITZ AND SIDE BET OPTIONS

CROSS REFERENCE TO RELATED APPLICATIONS

This application claims priority to U.S. Provisional Application Ser. No. 61/046,846 filed on Apr. 22, 2008, entitled: "Method for Playing a Card Game that Simulates a Game of Football with Kibitz and Side Bet Options". This reference is hereby incorporated in its entirety herein.

FIELD

The present embodiments generally relate to a method for playing a card game that simulates a game of football having kibitz and side bet options. The simulated football game closely follows how professional football games are played and includes kibitzing and betting features useable by both players and spectators for placing bets based on game outcome.

BACKGROUND

A need exists for a method for playing a card game that simulates a game of football and that closely follows the manner in which professional football games are played, which combines card gaming elements with gambling elements, such as those found at a casino table, allowing both players and spectators to participate and enjoy the simulated football game.

A further need exists for a method that simulates a game of football, which incorporates card game elements and strategies, such as bluffing, learning playing strategies of opponents, reading opponents to determine bluffs, counting cards, and the confrontation and competitive aspects of popular card games.

A need also exists for a method for playing a card game that simulates a game of football that allows both players and spectators to place bets on various play achievements and game outcomes, and receive winnings based on odds and game outcomes, in the style of popular casino table games.

The present embodiments meet these needs.

BRIEF DESCRIPTION OF THE DRAWINGS

The detailed description will be better understood in conjunction with the accompanying drawings as follows.

Figure 1:
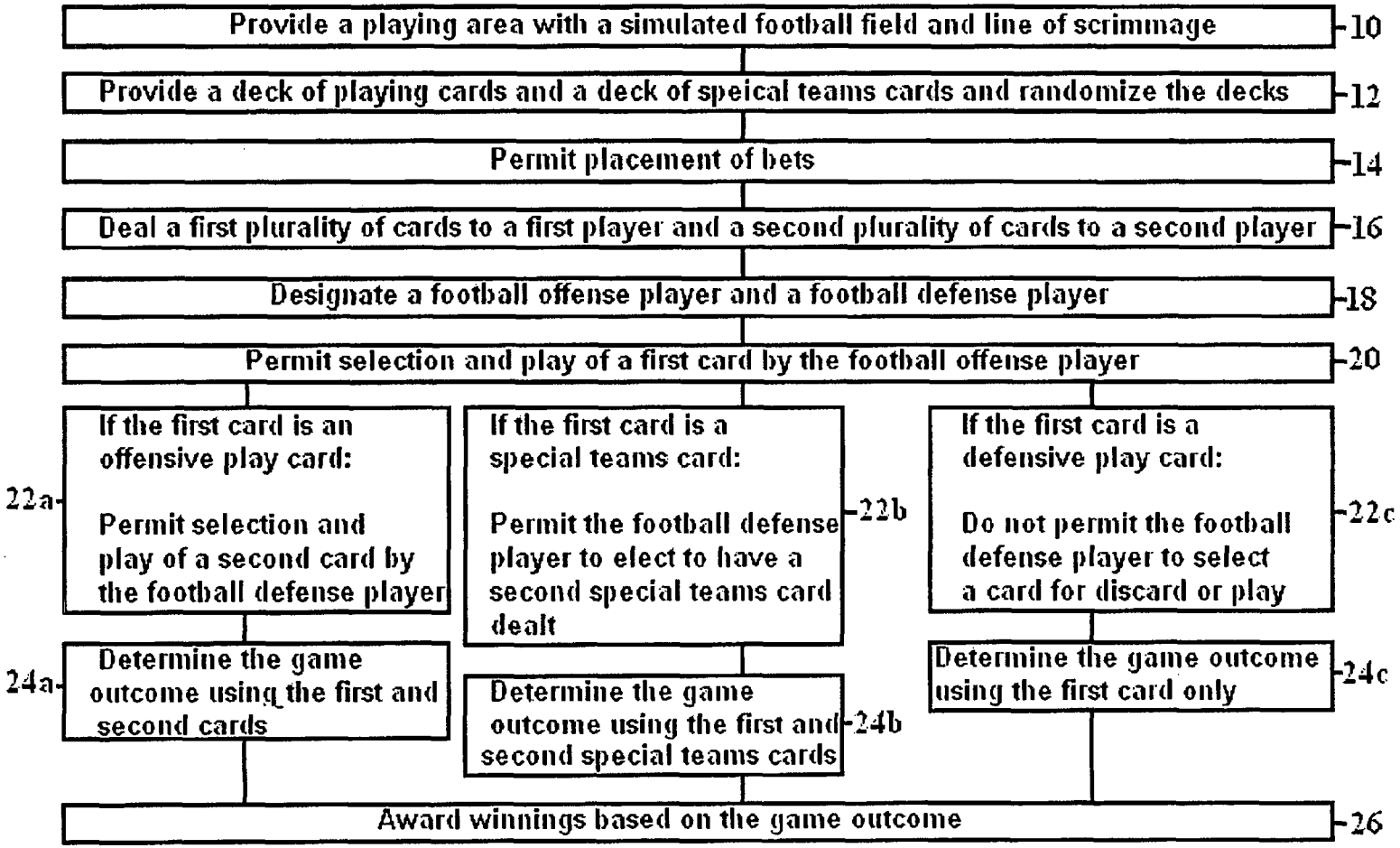
FIG. 1 depicts a diagram of an embodiment of the steps of the present method.

The present embodiments are detailed below with reference to the listed Figures.

DETAILED DESCRIPTION OF THE EMBODIMENTS

Before explaining the present method in detail, it is to be understood that the method is not limited to the particular embodiments and that it can be practiced or carried out in various ways.

The present embodiments relate to a method for playing a card game that simulates a game of football, which combines game-play and finesse elements found in popular card games with odds and gambling elements found in casino games.

The present method provides the benefit of enabling one or more players, as well as multiple spectators, to participate in a simulated football game that closely follows the manner in which professional football games are played. Offensive cards representing nearly all types of plays used in professional football can be played, each offensive card indicating an outcome, such as a gain of yards, or special instructions. Defensive cards having corresponding types of plays indicated thereon can be used to counter offensive cards, negating a gain of yards, causing a loss of yards, or providing other special instructions. Spectators are able to kibitz and place side bets relating to various game outcomes and play achievements.

Special teams cards can be dealt in certain circumstances, to simulate the results of special team plays, such as kickoffs, punts, punt returns, and field goal attempts. Bets can also be placed relating to the outcome of special team plays.

The present method can enable users to enjoy a simulated game of football that incorporates both card game and gambling elements, using the familiar setting and style of a casino-type table game.

The present method can advantageously enable at least one player, and any number of onlookers, to simultaneously engage in placement of a large variety of single-play and persistent bets that relate to a multitude of possible game outcomes. The present method can provide education relating to the sport of football to players and onlookers in a fun and entertaining manner, using the strategic and finesse-based elements of card gaming, and the odds-based elements of casino gambling.

The present method can further provide the benefit of incorporating both single-play and persistent bets. By permitting players and spectators to place "hard" bets that persist through several plays, or for the duration of a simulated game of football, players and spectators can be enticed to remain and continue placing bets until the outcome of a persistent bet is determined.

The present method can include providing a playing area that can include a simulated football field and a simulated line of scrimmage. In an embodiment, the simulated football field can include a gridiron, twenty yard markers that designate five-yard intervals, a down indicator, a score indicator, a possession indicator, a quarter indicator, or combinations thereof.

The playing area can be useable to visually display the progress and status of the simulated game of football, and can be updated after each play, as needed, such as by moving chips or game pieces that represent simulated football players, a simulated game ball, or markers for indicating downs, points, quarters, and/or possession.

In an embodiment, the playing area can also include a yards rushing indicator, a yards passing indicator, a total offense indicator, a field goals made indicator, a field goals missed indicator, a kickoff return yardage indicator, a punt return yardage indicator, other similar indicators for displaying game information and statistics, or combinations thereof.

Each indicator can be updated to track game information and statistics after each play, as needed. It can be contemplated that one or more bets can be placed relating to the information and statistics displayed in one or more indicators.

The present method can include providing a deck of playing cards, which can include offensive play cards and defensive play cards.

Offensive play cards can include run cards, which display thereon a type of football running play and a result, which can include a gain of yards. In an embodiment, run cards can include pitch out, end run, off tackle, trap play, flanker reverse, line plunge, draw play, end sweep, end around, or double reverse. Run cards can also include special instructions in addition to, or in lieu of a gain or yards, such as a quarterback sneak card.

Offensive play cards can also include pass cards, which display thereon a type of football passing play and a result, which can include a gain of yards. In an embodiment, pass cards can include tight-end pass, sideline pass, split-end pass, short pass, down and out pass, long pass, down and in pass, halfback pass, flanker screen pass, or fullback screen pass.

Offensive play cards can further include penalty cards, which can display thereon a type of football penalty called against a defensive team. Each penalty card can include a penalty name and a result, such as a gain or loss of yards and/or special instructions. In an embodiment, penalty cards can include defense offside cards.

Offensive play cards can also include option plays, which can provide a choice between a listed run or pass play, with or without special instructions, such as an "option play end run or pass complete" card.

Defensive play cards can include run cards that display a type of running play corresponding to one or more types of running plays listed on offensive play cards, paired with a result or instructions, such as a loss of yards or an indication of no gain. For example, an offensive play card reading "end run, 10 yard gain" can be played. In response to the offensive play card, a defensive play card reading "end run, no gain" can be played, nullifying the 10 yard gain of the offensive play card and resulting the accumulation of a down.

It can be contemplated that a football offense player can attempt to play offensive play cards for which a football defense player lacks a responsive card, while the football defense player can attempt to strategically predict and/or coax certain offensive play cards to be played. For example, a football defense player can elect to avoid playing an "end run, no gain" card in response to an offensive play card reading "end run, 5 yard gain," with the intent that a football offense player can falsely conclude that the football defense player lacks any cards to counter an end run card. Then, if the football offense player plays a second end run offensive play card, such as a card reading, "end run, 15 yard gain," the football defense player can then play the "end run, no gain" card.

As play progresses, it can be contemplated that players and spectators can track past plays and count cards, facilitating the prediction of future plays and the strategic placement of bets based on perceived remaining cards and odds.

Defensive play cards can also include pass cards that display a type of passing play corresponding to one or more types of passing plays listed on offensive play cards, paired with a result or instructions, such as an indication of an incomplete pass, resulting in the accumulation of a down.

Defensive play cards can further include special cards, such as an interception card, which indicates the interception of a specified type of pass, paired with a result, such as a number of yards gained by the defensive team, and which can include special instructions. Special cards can also include quarterback sack cards, which can include a result, such as a loss of yards, and/or special instructions. Special cards can also include option plays, which can include one or more types of play listed on an offensive play cards, paired with results and/or special instructions.

Special cards can also include a fumble card, which can include special instructions, and which can result in a turnover, causing the offensive team to be designated as the defensive team, and vice versa.

Defensive cards can additionally include penalty cards, which include a type of football penalty called against an offensive team, and a result, such as a loss of yards and/or special instructions. In an embodiment, penalty cards can include offensive holding and offense offside cards.

The present method can also include providing a deck of special teams cards, used to simulate special teams plays undertaken by both offensive and defensive football teams. It can be contemplated that cards from the deck of special teams cards can be dealt randomly when placed in play, rather than selected by players for use.

It can be contemplated that a football offense player can elect to have a special teams card dealt in lieu of playing an offensive or defensive football card, to simulate special team plays, such as field goal attempts, points after touchdowns, punts, punt returns, and kickoff returns. Each special teams card can be contemplated to include a list of results, which can include a number of yards gained or lost, success or lack thereof of a field goal or point after touchdown, a fumble, a touchback, a blocked punt or field goal, a touchdown, or a similar result. Each listed result can be displayed on a special teams card in association an item from a list of special teams plays, such as a field goal attempt, a point after touchdown attempt, a punt attempt, a punt return attempt, and a kick off return attempt.

Both the deck of playing cards and the deck of special teams cards can be contemplated to be randomized prior to beginning play. Once one of the decks is exhausted, it can be contemplated that the exhausted deck is again randomized prior to resuming play. The duration of the simulated game of football can be determined based on the exhaustion of the deck of playing cards. For example, each time the deck of playing cards is exhausted, it can be declared that one half of the simulated game of football has expired.

The present method can then include permitting placement of bets from one or more spectators. In an embodiment, spectators can be permitted to place a primary bet, such as a bet predicting the winner of the simulated game of football, or a bet predicting the outcome of the next card played, in addition to one or more secondary bets, such as bets relating to specific game outcomes throughout the simulated game of football.

Bets can include "soft" side-bets, such as a bet that the next card played will result in a successful run, a failed run, a successful pass, a failed pass, a first down, a successful field goal, a missed filed goal, a touchdown, a safety, a turnover, a third down conversion, a fourth down conversion, or other similar game outcomes.

Bets can also include "hard" bets that persist for a simulated possession, which can include up to four simulated plays, such as a bet that the current possession will result in a first down, a punt, a third down conversion, a fourth down conversion, a successful field goal, a missed field goal, a touchdown, a safety, a turnover, or other game outcomes.

Bets can further include "hard" bets that persist for an extended portion of the simulated game of football, such as a quarter or a half, or for the duration of the simulated game of football. Such bets can include a bet predicting which team will win the game, one or more point totals or point spreads at certain points in the game, whether the game will be tied at the end of regular play and extend into overtime, which team will win during overtime, whether a safety will occur, independent or comparative predictions of total values of various game statistics, such as total yards rushed, total yards passed, total field goals made or missed, total yards punted, or total yards returned during punt return plays, or other similar types of bets.

It can be contemplated that allowable bets, the odds and payoffs relating to each bet can be individually set by facilities. For example, a casino can elect to allow certain point spread bets at certain tables, or to disallow point spread bets entirely. A casino can choose to award a jackpot to a player when the player wins a game that extends into overtime.

The present method can then include dealing a first plurality of cards from the deck of playing cards to a first player and dealing a second plurality of cards from the deck of playing cards to a second player. It can be contemplated that the second player can be a facility-appointed dealer representing the facility, such as a casino dealer playing for "the house."

Each plurality of cards can be contemplated to represent a player's hand. Each hand can include from about five to about eleven cards, but additional cards can be used for various games of play. For example, a five-card hand can be used when playing a short game at a low stakes table, while an eleven card hand, representative of the number of participating players on a football team, can be used in a high roller game at a casino.

A football offense player and a football defense player can then be designated. The designation can be performed randomly, or through selection by one or both players. In an embodiment, the designation can be performed by permitting selection of a coin toss outcome by a designating player, performing a coin toss or a simulated coin toss to generate a coin toss outcome, and permitting designation of the football offense and football defense players by the designating player if the selected outcome matches the coin toss outcome.

The present method can then include permitting the football offense player to select and play a first card. The football offense player can then be dealt a replacement card for the first card from the deck of playing cards.

It can be contemplated that typically, the football offense player can play an offensive play card to attempt to gain a number of yards and/or score points.

In the event that the football offense player selects an offensive play card, the football defense player can be permitted to select and play a second card. The second card can be selected for discard, or the second card can be a defensive play card having a type of play indicated thereon that corresponds to the type of play indicated on the offensive play card.

Even if the second card is discarded, it can be contemplated that the discarded card can be shown to the players and spectators, to facilitate counting of cards, tracking of possible future plays, and strategic betting.

In the event that the football defense player selects a defensive play card having a type of play corresponding to the offensive play card, both the offensive play card and the defensive play card can be used to determine the game outcome.

The football defense player can then be dealt a replacement card for the second card from the deck of playing cards.

It can also be contemplated that the football offense player can perform a tactic known as "clutching," by playing a defensive play card rather than an offensive play card. The football offense player can voluntarily incur the negative consequences of the selected defensive play card, and then be dealt a replacement card for the selected defensive play card. This strategy can be useful when a player wishes to intentionally lose one or more individual plays to cause a desirable long term game outcome, such as a resulting specified point total on which the player has placed a secondary bet. "Clutching" can also be useful when a football offense player lacks sufficient offensive play cards to score points but possesses special defensive play cards that could possibly cause a turnover or a safety when playing as the football defense player.

If the football offense player plays a defensive play card, it can be contemplated that the football defense player is not permitted to select a second card for discard or to select a second card to play in response for the first card.

Game outcomes can include a gain or loss of yards, scored points, accumulating a down, achieving a new first down, a turnover, which causes the football defense player to be designated as the football offense player and the football offense player to be designated as the football defense player, or other similar results.

After each play, winnings can be awarded based on any of the bets and the game outcome, as appropriate.

In an embodiment, the present method can include permitting the football offense player to select one or more cards for placement in an offense time out hand, which can be set aside separately from the foot ball offense player's hand. The football defense player can also be permitted to select one or more cards to form a defense time out hand, which is also set aside.

The present method can then include permitting the football offense player or the football defense player to declare a time out during play, and permitting each player to select cards for exchange with selected cards from their respective time out hands. It can be contemplated that each player can be permitted to declare a time out a limited number of times, such as twice per each half of the simulated game of football.

For example, a football defense player can select five offensive play cards for placement in a time out hand, while retaining sufficient defensive play cards to cause a turnover, which designates the football offense player as the football defense player and the football defense player as the football offense player. At that time, the football offense player, who was previously the football defense player, can declare a time out and exchange one or more cards with the time out hand to acquire the offensive play cards that were placed in the time out hand.

A simulated game of football can be divided into quarters, halves, or other segments of time by automatically determining that each segment of time expires after a predetermined number of cards have been played. Users or facilities using the present method can be permitted to select the length of each half, or other time segment, of the simulated football game. For example, each time the deck of playing cards is exhausted, it can be declared that one half of the simulated game of football has expired. The present method can then include randomizing the cards and dealing hands to each player to begin the second half of play.

In an embodiment, the present method can include permitting the football offense player to elect to perform a special teams play in lieu of selecting the first card. The football offense player can then be dealt a first special teams card from the deck of special teams cards. The first special teams card can be used to determine the game outcome.

For example, if a simulated line of scrimmage is within thirty yards of a simulated defense team's goal line, a special teams card can be dealt to the football offense player to represent an attempt to score a field goal. The special teams card can then indicate whether points are scored, or whether the simulated field goal attempt was missed. If the simulated line of scrimmage is farther than thirty yards from the simulated defense team's goal line, the special teams card can be dealt to represent an attempt to punt.

If the football offense player elects to perform a special team play, the football defense player can be permitted to elect to perform a special teams response in response to the first special teams card. A second special teams card from the deck of special teams cards can be dealt to the football defense player. The game outcome can then be determined based on both special teams cards.

For example, a football offense player can elect to have a first special teams card dealt to simulate a punt attempt. The first special teams card can display a number of yards or another result or instruction associated with a punt attempt. The football defense player can then elect to have a second special teams card dealt to simulate a punt return, which can display a number of yards returned, or another result, such as a blocked punt or a fumble, in association with a punt return attempt.

The football defense player can also elect not to have a second special teams card electronically dealt in response to the first special teams card. For example, to simulate a fair catch, the football defense player can permit a simulated punt attempt to take place without attempting a simulated punt return.

Referring now to FIG. 1, a diagram depicting an embodiment of the steps of the present method is depicted.

FIG. 1 depicts the present method including the step of providing a playing area with a simulated football field and a simulated line of scrimmage (10). The playing area can include any suitable surface, such as a casino table. It can be contemplated that the playing area can also include one or more areas for placing or tracking bets, game information, game statistics, or combinations thereof.

A deck of playing cards and a deck of special teams cards can then be provided and randomized (12). It can be contemplated that the playing area can include areas for placing the decks during play. In an embodiment, the decks can be retained by a human dealer or a mechanical means for dealing cards, rather than placed in the playing area.

FIG. 1 then depicts permitting placement of bets (14). Any number and any type of bets can be placed by the player and any number of spectators. It can be contemplated that specific "house rules" relating to allowable bets, odds, winnings, or timing of bets can be instituted, enabling the present method to be customized to meet the needs of a facility.

A first plurality of cards can then be dealt to a first player, and a second plurality of cards can be dealt to a second player (16). Each player can be contemplated to maintain his or her hand concealed from both the other player, and from all spectators, to maintain the fairness of the gambling environment.

FIG. 1 then depicts designating a football offense player and a football defense player (18). Offense and defense players can be designated by "house rules," using a coin toss or simulated coin toss, at random, or through other similar means.

The football offense player can then be permitted to select and play a first card (20). The first card can be an offensive play card, a defensive play card, or it can be contemplated that the football offense player can elect to have a special teams card dealt in lieu of selecting a card from the football offense player's hand for play. A replacement card for the first card can then be dealt to the football offense player.

If the first card is an offensive play card, the football defense player can be permitted to select a second card (22*a*). The second card can be selected for discard, so that a replacement card can be dealt to the football defense player. The second card can also be selected for play, in response to the offensive play card.

The game outcome can then be determined using the first and second cards (24*a*). If the second card was discarded, rather than played in response to the offensive play card, then it can be contemplated that the second card will have no effect on the game outcome.

If the first card is a defensive play card, then it can be contemplated that the football defense player is not permitted to select a card for discard or play (22*c*). The game outcome can be determined using the first card only (24*c*). By selecting a defensive play card, it can be contemplated that a football offense player can strategically incur choice negative consequences without permitting the football defense player to select or discard cards. Additionally, the football offense player can strategically attempt to attain certain point totals or certain game outcomes through selection of defensive play cards.

If the first card is a special teams card, the football defense player can be permitted to elect to have a second special teams card dealt (22*b*). If a second special teams card is dealt, the game outcome can be determined using both special teams cards (24*b*). If the football defense player does not elect to have a second special teams card dealt, it can be contemplated that the game outcome can be determined using only the first special teams card.

After determining the game outcome, FIG. 1 depicts that winnings are awarded based on the game outcome (26).

Figure 2:
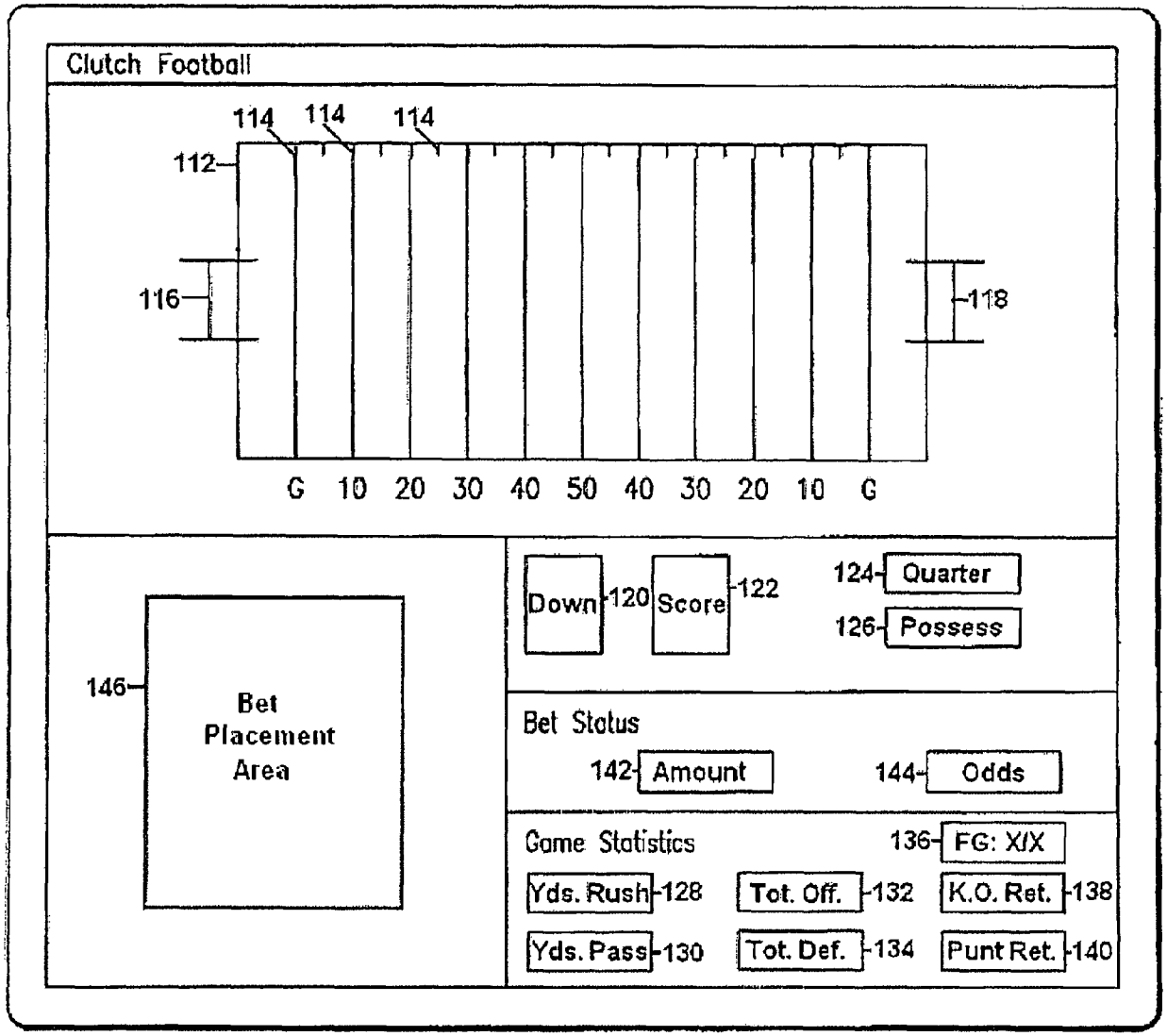
FIG. 2 depicts a display of an embodiment of a simulated football field.

FIG. 2 depicts an embodiment of a simulated football field (112) which can be displayed on a playing area, such as a casino table. The simulated football field (112) is shown having a plurality of yard markers (114), each designating a five-yard interval, a first football goal (116), and a second football goal (118).

FIG. 2 also depicts an area for indicating downs (120) and an area for indicating score (122), which can be contemplated to be useable for displaying numbers of downs and points scored, as determined by the game outcome. Any type of tabular or numeric means using chips, game pieces, or similar items can be used to indicate numbers of points and downs.

FIG. 2 further depicts a quarter indicator (124), for indicating the current quarter of the simulated game of football. The quarter indicator (124) can also indicate halves, or other segments of simulated time. FIG. 2 additionally depicts a possession indicator (126), for indicating the player which is currently the football offense player. Game pieces, chips, markers, numbers, or other similar items or means can be used to indicate quarters and possession.

FIG. 2 also depicts numerous indicators for game statistics, including a yards rushing indicator (128), a yards passing indicator (130), a total offense indicator (132), and a total defense indicator (134). A field goal indicator (136) is also depicted, which can indicate both a number of field goals made and a number of field goals missed, or a percentage, fraction, or decimal representing the portion of field goals made. The field goal indicator (136) can also include two separate indicators, a first indicating a number of field goals made and a second indicating a number of field goals missed.

A kickoff return yardage indicator (138) and a punt return yardage indicator (140) can also be used and are depicted.

Game pieces, chips, markers, numbers, or other similar items or means can be used to provide updated quantities in each of the indicator areas.

FIG. 2 further depicts areas or indicating primary bets, which can include a bet amount indicator (142) and an odds indicator (144). Other indicators relating to bets made relating to the game outcome can also be displayed.

FIG. 2 also depicts an area for displaying one or more secondary bets (146). The area for displaying secondary bets (146) can include any number of areas, each relating to an individual bet, such as successful run, unsuccessful run, successful pass, unsuccessful pass, successful field goal, unsuccessful field goal, first down, touchdown, punt, third down conversion, fourth down conversion, turnover, safety, game winner, one or more point spread bets, overtime, overtime game winner, total offense yards, total defense yards, total yards passing, total yards rushing, total field goals made, total field goals missed, total yards punting, total yards on punt return, total yards on kickoff, total yards on kickoff return, or any similar bets relating to any possible game outcome.

Each area relating to an individual bet can also display odds and/or payouts relating to the individual bet, any special instructions relating to the individual bet, an indication of whether the individual bet is "soft" or "hard," or other similar information.

While these embodiments have been described with emphasis on the embodiments, it should be understood that within the scope of the appended claims, the embodiments might be practiced other than as specifically described herein.

What is claimed is:

1. A method for playing a card game that simulates a game of football with kibitz and side bet options, the method comprising:

providing a table as a playing area comprising:

a simulated football field and a simulated line of scrimmage;

areas for placing a deck of playing cards;

a plurality of yard markers;

a first football goal and a second football goal; and indicators comprising: tabular means, numeric means, chips, numbers, markers, or game pieces for indicating bets, game information, game statistics, or combinations thereof;

providing the deck of playing cards comprising offensive play cards and defensive play cards;

providing a deck of special teams cards;

randomizing the deck of playing cards and the deck of special teams cards;

permitting placement of at least one bet from at least one spectator;

dealing a first plurality of cards from the deck of playing cards to a first player;

dealing a second plurality of cards from the deck of playing cards to a second player;

designating a football offense player and a football defense player;

permitting selection and play of a first card by the football offense player, wherein the first card is a first offensive card or a first defensive card;

indicating a first outcome with the first offensive card or the first defensive card;

dealing a replacement card for the first card from the deck of playing cards to the football offense player;

determining a game outcome based on the first card;

positioning the simulated line of scrimmage within the simulated football field based on the game outcome;

awarding winnings based on the at least one bet and the game outcome;

placing, displaying, and tracking: the bets, the game information, the game statistics, or combinations thereof using the playing area and the indicators;

visually displaying a progress and a status of the card game that simulates the game of football with kibitz and side bet options using the playing area and the indicators; and updating the progress and the status of the card game that simulates the game of football with kibitz and side bet options using the playing area and the indicators.

2. The method of claim 1, further comprising:

permitting selection and play of a second card by the football defense player for discard or in response to the first card, wherein the second card is a second offensive card or a second defensive card;

indicating a second outcome with the second card;

dealing a replacement card for the second card from the deck of playing cards to the football defense player; and wherein the step of determining the game outcome comprises determining the game outcome based on the first card and the second card.

3. The method of claim 2, further comprising indicating as the first outcome:

a. a gain of yards, a pitch out, an end run, an off tackle, a trap play, a flanker reverse, a line plunge, a draw play, an end sweep, an end around, a double reverse, a quarterback sneak card, or a special instruction using a run card as the first card;

b. a tight end pass, a sideline pass, a split-end pass, a short pass, a down and out pass, a long pass, a down and in pass, a halfback pass, a flanker screen pass, or a fullback screen pass using a pass card as the first card;

c. a gain or loss of yards or a another special instruction using a penalty card comprising a penalty name and result as the first card;

d. a choice between a listed run or a pass play using an option play as the first card;

e. a loss of yards or no gain of yards using is a defensive run card as the first card;

f. an incomplete pass resulting in a down using a defensive pass card as the first card;

g. an interception of a specified type of pass paired with a result, a quarterback sack, or a fumble resulting in a turnover using a special card as the first card; or h. a penalty using a penalty card as the first card.

4. The method of claim 3, further comprising indicating as the second outcome:

a. a gain of yards, a pitch out, an end run, an off tackle, a trap play, a flanker reverse, a line plunge, a draw play, an end sweep, an end around, a double reverse, a quarterback sneak card, or a special instruction using a run card as the second card;

b. a tight end pass, a sideline pass, a split-end pass, a short pass, a down and out pass, a long pass, a down and in pass, a halfback pass, a flanker screen pass, or a fullback screen pass using a pass card as the second card;

c. a gain or loss of yards or a another special instruction using a penalty card comprising a penalty name and result as the second card;

d. a choice between a listed run or a pass play using an option play as the second card;

e. a loss of yards or no gain of yards using is a defensive run card as the second card;

f. an incomplete pass resulting in a down using a defensive pass card as the second card;

g. an interception of a specified type of pass paired with a result, a quarterback sack, or a fumble resulting in a turnover using a special card as the second card; or h. a penalty using a penalty card as the second card.

5. The method of claim 1, further comprising:

permitting selection of at least one card by the football offense player to form an offense time out hand;

permitting selection of at least one card by the football defense player to form a defense time out hand;

permitting the football offense player or the football defense player to declare a time out prior to permitting the football offense player to select and play the first card;

permitting the football offense player to exchange at least one card with the offense time out hand; and permitting the football defense player to exchange at least one card with the defense time out hand.

6. The method of claim 1, further comprising:

permitting the football offense player to elect to perform a special teams play in lieu of selecting the first card;

dealing a first special teams card from the deck of special teams cards to the football offense player; and wherein step of determining the game outcome comprises determining the game outcome based on the first special teams card.

7. The method of claim 6, further comprising:

permitting the football defense player to elect to perform a special teams response in response to the first special teams card;

dealing a second special teams card from the deck of special teams cards to the football defense player; and wherein the step of determining the game outcome comprises determining the game outcome based on the first special teams card and the second special teams card.

8. The method of 7, further comprising stimulating results of special team plays using the first special teams card and the second special teams card, wherein the special team plays include: kickoff attempts, kickoff return attempts, field goal attempts, points after touchdown attempts, punt attempts, and punt return attempts, and wherein each special teams card comprises a list of results including: a number of yards gained or lost, a success or lack thereof of a field goal or point after touchdown, a fumble, a touchback, a blocked punt or field goal, a touchdown.

9. The method of claim 1, wherein the simulated football field further comprises a gridiron, wherein the plurality of yard markers comprise twenty yard markers that designate five-yard intervals, wherein the indicators comprise a down indicator, a score indicator, a possession indicator, a quarter indicator, or combinations thereof; and wherein the method further comprises:

displaying the game information, the game statistics, or combinations thereof using the down indicator, the score indicator, the possession indicator, and the quarter indicator; and updating on the simulated football field a number of downs, a score, a possession, a quarter, or combinations thereof, based on the game outcome by updating the down indicator, the score indicator, the possession indicator, and the quarter indicator to track the game information and the game statistics after each play.

10. The method of claim 9, wherein the indicators further comprise a yards rushing indicator, a yards passing indicator, a total offense indicator, a total defense indicator, a field goals made indicator, a field goals missed indicator, a kickoff return yardage indicator, a punt return yardage indicator, or combinations thereof; and wherein the method further comprises:

displaying the game information, the game statistics, or combinations thereof using the yards rushing indicator, the yards passing indicator, the total offense indicator, the total defense indicator, the field goals made indicator, the field goals missed indicator, the kickoff return yardage indicator, the punt return yardage indicator, or combinations thereof; and updating a number of yards rushed, a number of yards passed, a total offense, a total defense, a number of field goals made, a number of field goals missed, a kickoff return yardage, a punt return yardage, or combinations thereof, based on the game outcome by updating the yards rushing indicator, the yards passing indicator, the total offense indicator, the total defense indicator, the field goals made indicator, the field goals missed indicator, the kickoff return yardage indicator, the punt return yardage indicator, or combinations thereof to track the game information and the game statistics after each play.

11. The method of claim 1, wherein the step of designating the football offense player and the football defense player comprises:

permitting selection of a coin toss outcome by the first player or the second player forming a selected coin toss outcome by a designating player;

performing a coin toss or a simulated coin toss to generate a coin toss outcome; and permitting designation of the football offense player and the football defense player by the designating player if the coin toss outcome matches the selected coin toss outcome.

12. The method of claim 1, further comprising:

permitting selection by the football offense player of at least one offense card for discard, permitting selection by the football defense player of at least one defense card for discard, or combinations thereof; and dealing a replacement card from the deck of playing cards to replace the at least one offense card for discard, the at least one defense card for discard, or combinations thereof.

13. The method of claim 1, wherein the at least one bet comprises a point spread bed, a game winner bet, a play achievement bet, a game outcome bet, or combinations thereof.

14. The method of claim 1, further comprising permitting placement of at least one secondary bet by at least one spectator and awarding winnings based on the at least one bet, the at least one secondary bet, and the game outcome.

15. The method of claim 11, wherein the at least one secondary bet comprises a successful run bet, a failed run bet, a successful pass bet, a failed pass bet, a first down bet, a successful field goal bet, a missed field goal bet, a touchdown bet, a safety bet, a turnover bet, a third down conversion bet, a fourth down conversion bet, a punt bet, a game winner bet, a point spread bet, an overtime bet, an overtime winner bet, a game statistic bet, or combinations thereof.

16. The method of claim 1, wherein the second player is a facility-appointed dealer playing on behalf of a facility.

17. The method of claim 1, wherein updating the progress and the status of the card game that simulates the game of football with kibitz and side bet options using the playing area comprises moving the indicators, wherein the indicators represent: simulated football players, a simulated game ball, downs, points, quarters, and possession.

18. The method of claim 1, further comprising providing education related to football to the first player, the second player, and the at least one spectator.

19. The method of claim 1, further comprising declaring that one half of the card game that simulates the game of football with kibitz and side bet options has expired each time that the deck of playing cards is exhausted.

20. The method of claim 12, further comprising showing discarded cards to the first player and the second player to facilitate counting of cards, tracking of possible future plays, and strategic betting.

* * * * *